US006477217B1

(12) United States Patent
Hino et al.

(10) Patent No.: US 6,477,217 B1
(45) Date of Patent: Nov. 5, 2002

(54) TARGET FOR NEUTRON SCATTERING INSTALLATION

(75) Inventors: Ryutaro Hino, Tokai-mura (JP); Masanori Kaminaga, Tokai-mura (JP); Hidetaka Kinoshita, Tokai-mura (JP); Noriaki Anbo, Yokohama (JP); Atsuhiko Terada, Tokai-mura (JP); Hiroyuki Uchida, Machida (JP)

(73) Assignees: Agency of Industrial Science and Technology Japan Atomic Energy Research Institute, Tokyo-to (JP); Ishikawajima-Harima Jukogyo Kabushiki Kaisha, Tokyo-to (JP)

( * ) Notice: Subject to any disclaimer, the term of this patent is extended or adjusted under 35 U.S.C. 154(b) by 0 days.

(21) Appl. No.: 09/499,678

(22) Filed: Feb. 8, 2000

(30) Foreign Application Priority Data

Feb. 19, 1999 (JP) ..... 11-041501
Jan. 25, 2000 (JP) ..... 2000-015826

(51) Int. Cl.[7] ..... G21G 1/10

(52) U.S. Cl. ..... 376/194; 376/192; 376/193; 376/195; 376/196; 376/197; 376/199; 376/202; 376/376; 376/388; 376/398; 376/453; 376/454; 376/102; 376/103; 376/105; 376/106; 376/108; 376/109; 250/250; 250/305; 250/315.3; 250/396; 250/492.23

(58) Field of Search ..... 376/192, 193, 376/194, 195, 196, 197, 199, 202, 376, 388, 398, 453, 454, 102, 103, 105, 106, 108, 109; 250/250, 305, 315.3, 396, 492.23

(56) References Cited

U.S. PATENT DOCUMENTS 3,886,483 A * 5/1975 Miley ..... 372/37
4,696,191 A * 9/1987 Claytor et al. ..... 73/19.01
5,311,955 A * 5/1994 Ganijew et al. ..... 175/393

FOREIGN PATENT DOCUMENTS

DE 2435603 * 2/1975
JP 11-273896 10/1999
JP 11-297498 10/1999
JP 2000-82598 * 3/2000

* cited by examiner

*Primary Examiner*—Charles T. Jordan
*Assistant Examiner*—John Richardson
(74) *Attorney, Agent, or Firm*—Oblon, Spivak, McClelland, Maier & Neustadt, P.C.

(57) ABSTRACT

Flow of mercury from a liquid-heavy-metal inflow port toward an inner forward end of a container body is rectified by a plurality of incoming-passage guide vanes in a liquid-heavy-metal incoming passage. Flow of the mercury from the forward end of the container body toward a liquid-heavy-metal outflow port is rectified by a plurality of return-passage guide vanes in a liquid-heavy-metal return passage. As a result, occurrence of stagnation and/or recirculation flows of the mercury in the container body is suppressed and a steady and highly uniform stream of the mercury is formed throughout in the container body. The container body is covered with a container outer shell to prevent any leakage of the mercury to outside due to a damage of the container body.

3 Claims, 6 Drawing Sheets

TARGET FOR NEUTRON SCATTERING INSTALLATION

BACKGROUND OF THE INVENTION

The present invention relates to a target for a neutron scattering installation.

FIG. 1 shows an example of a neutron scattering installation for performing various research studies on physical properties using neutrons. In the installation, protons from a proton emitter 1 are accelerated by a linear accelerator 2 to enter into an accumulation ring 3 where the protons are circulated by curving their orbits with a deflecting electromagnet and are increased in velocity using high frequency electric current until required energy can be reached.

The protons thus having the required energy are emitted from the ring 3 to a target 4 where they are brought to collide against liquid heavy metal such as mercury held in the target 4. Fast neutrons generated by nuclear spallation reaction are passed through a moderator such as liquid hydrogen (20 K; 1.5 MPa) held in a moderator container 5 so that they are converted into thermal or cold neutrons suitable for research purpose; these are guided via a beam line 6 to a laboratory 7.

FIG. 2 shows a conventional target for a neutron scattering installation which comprises a container body 8 arranged to counter a proton beam P, which advances approximately horizontally, and a partition 9 having its opposite edges contiguous with a lower inner surface portion of the body 8 and extending from a base end of the body 8 to a position near a forward end of the body 8.

The container body 8 has, at its base end, inflow and outflow ports 11 and 13. The inflow port 11 serves to communicate outside of the body 8 with a liquid-heavy-metal incoming passage 10, which is a space defined between the inner surface of the body 8 and a lower surface of the partition 9. The outflow port 13 serves to communicate outside of the body 8 with a liquid-heavy-metal return passage 12, which is a space defined between the inner surface of the body 8 and an upper surface of the partition 9.

The inflow port 11 is connected with a discharge port of a pump 14 and the outflow port 13 is connected with a suction port of the pump 14 via a heat exchanger 15. Thus, the pump 14, inflow port 11, incoming and return passages 10 and 12, outflow port 13 and heat exchanger 15 compose a closed loop which is filled with mercury M as liquid heavy metal.

In the target shown in FIG. 2, fast neutrons are generated by collision of the protons against the mercury M, which flows via the incoming passage 10 to an inner forward end of the container body 8. The mercury M having received heat from the nuclear spallation reaction is then guided via the return passage 12 to the heat exchanger 15 so as to be cooled down.

However, in the system shown in FIG. 2, the whole of the mercury M supplied to the inflow port 11 makes up a mercury stream which flows via the incoming passage 10 to the inner forward end of the body 8 and turns back via the return passage 12, so that stagnation and/or re-circulation flows R tend to occur near the inner forward end of the body 8. Constant stagnation of the mercury M may lead to occurrence of local increase in temperature (hot spots).

Since the mercury M is brought to continuously flow at higher flow rate in the container body 8 so as to remove the heat caused by nuclear spallation, extremely high burdens are applied on cooling means of, for example, the mercury circulation pump 14 and heat exchanger 15, which makes it difficult to cope with nuclear spallation reaction having higher heat generated.

The present invention was made to solve the above problems and has its object to provide a target for a neutron scattering installation which can provide a stead and highly uniform stream of liquid heavy metal throughout in the system.

BRIEF SUMMARY OF THE INVENTION

In a target for a neutron scattering installation according to any of claims 1 to 3 of the invention, the flow of the liquid heavy metal from the liquid-heavy-metal inflow port toward the inner forward end of the container body is rectified by a plurality of incoming-passage guide vanes installed closer to one side in the container body, and the flow of the liquid heavy metal from the forward end of the container body toward the liquid-heavy-metal outflow port is rectified by a plurality of return-passage guide vanes installed closer to the other side in the container body, thereby suppressing occurrence of stagnation and/or re-circulation flows of the liquid heavy metal in the container body.

In a target for a neutron scattering installation according to claim 2 of the invention, the container body in which the liquid heavy metal flows is covered with a container outer shell, thereby preventing any leakage of the liquid heavy metal to outside as may be caused by damage of the container body.

In a target for a neutron scattering installation according to claim 3 of the invention, the container body in which the liquid heavy metal flows is dually covered by container intermediate and outer shells, thereby preventing any leakage of the liquid heavy metal to outside as may be caused by damage of the container body.

DETAILED DESCRIPTION OF THE PREFERRED EMBODIMENTS

Preferred embodiments of the invention will be described in conjunction with the attached drawings.

Figure 3:
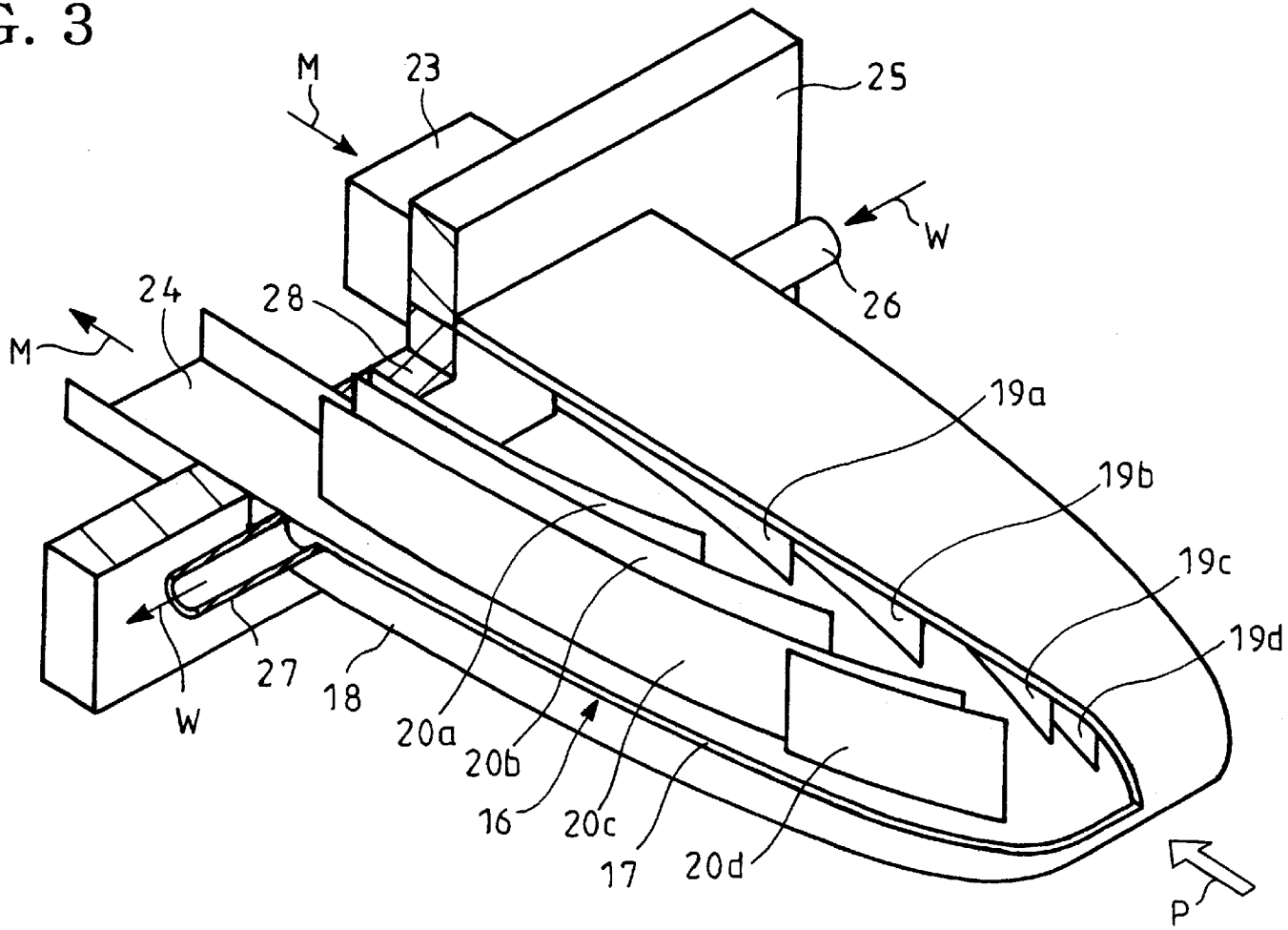
FIG. 3 is a perspective view partly in section of a first embodiment according to the invention.
Figure 4:
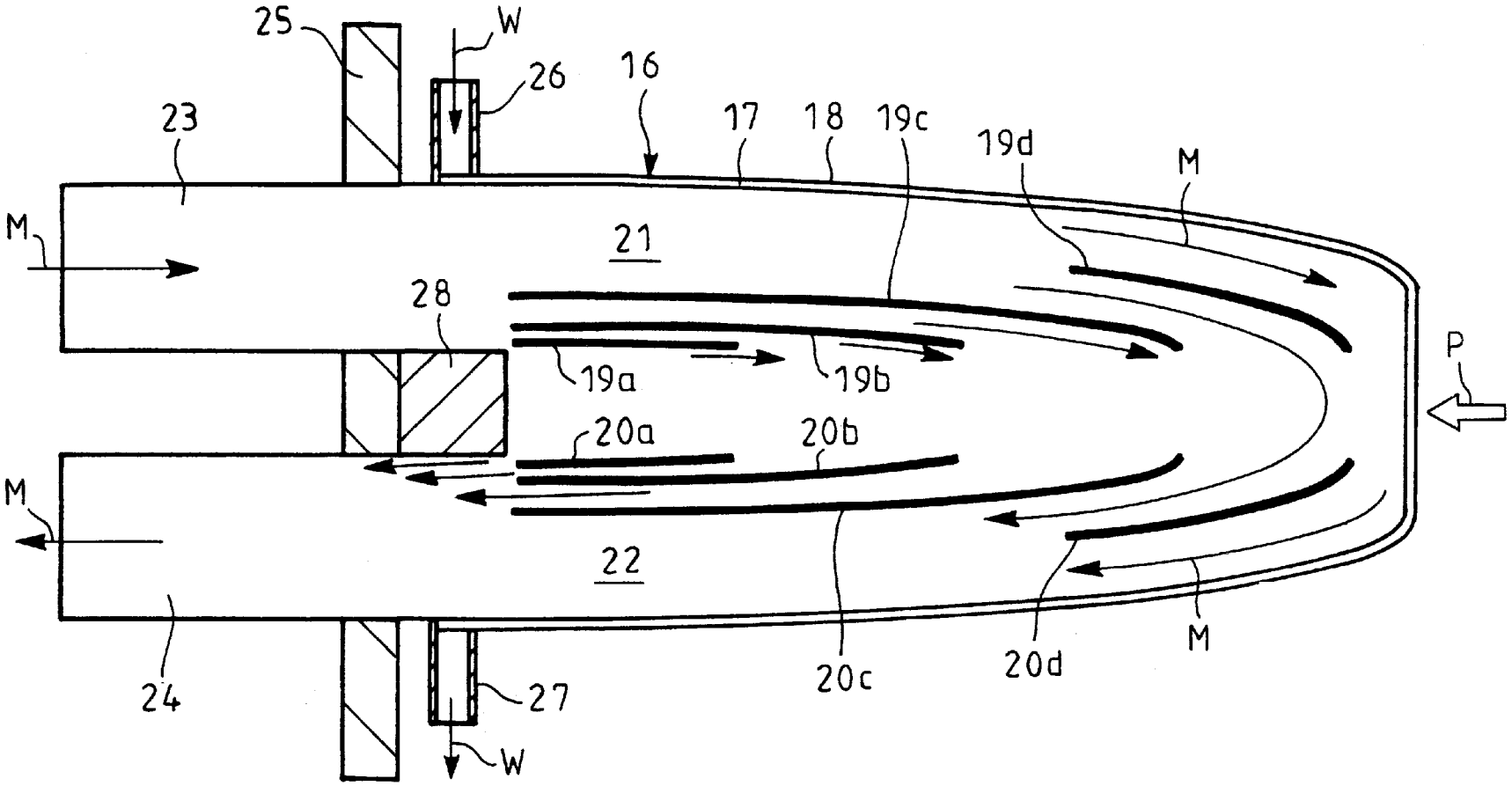
FIG. 4 is a horizontal sectional view of the first embodiment.

FIGS. 3 and 4 represent a first embodiment of a target for a neutron scattering installation according to the invention which comprises a thin-wall container body 16 arranged such that a proton beam P advancing approximately horizontally can enter a forward end of the body 16, a thin-wall container outer shell 18 for covering the container body 16 such that a space 17 is defined between the outer shell 18 and an outer surface of the body 16 and incoming- and return-passage guide vanes 19*a*–19*d* and 20*a*–20*d* installed in the container body 16. A space in the container body 16 closer to one side of the body 16 provides a liquid-heavy-metal incoming passage 21 and a space in the container body 16 closer to the other side of the body 16 provides a liquid-heavy-metal return passage 22.

The container body 16 has, at its base ends, a liquid-heavy-metal inflow port 23 for inflow of the mercury M from outside to the incoming passage 21 and a liquid-heavy-metal outflow port 24 for outflow of the mercury M from the return passage 22 to outside, independently from each other. A flange 25 is mounted to surround these ports 23 and 24.

The outer shell 18 is liquid-tightly mounted at its base ends to the flange 25.

A portion of the outer shell 18 closer to one base end thereof is provided with a cooling-medium inflow port 26 for inflow of cooling water W to the space 17 from outside. A portion of the outer shell 18 closer to the other base end thereof is provided with a cooling-medium outflow port 27 for outflow of the cooling water W to outside from the space 17.

In the space 17, a guide member (not shown) contiguous with the inner surface of the outer shell 18 and with the outer surface of the container body 16 is installed at an appropriate position, which will contribute to prevention of short-circuit flow of the cooling water W from the inflow port 26 to the outflow port 27.

The incoming-passage guide vanes 19*a*–19*d* are arranged in the incoming passage 21 and have upper and lower edges contiguous with the inner surface of the container body 16. The guide vanes 19*a*–19*d* are laterally spaced apart from each other and are gradually curved toward the center of the container body 16 in a direction from the base end to the forward end of the container body 16.

The return-passage guide vanes 20*a*–20*d* are arranged in the return passage 22 and have upper and lower edges contiguous with the inner surface of the container body 16. The guide vanes 20*a*–20*d* are laterally spaced apart from each other and are gradually curved toward the center of the container body 16 in a direction from the base end to the forward end of the container body 16.

These guide vanes 19*a*–19*d* and 20*a*–20*d* also serve as reinforcement members for the container body 16.

The container body 16 is provided, at a center of its base end, with a beam stopper 28 for blocking protons which pass through the outer shell 18 and container body 16 and advance between the guide vanes 19*a*–19*d* and 20*a*–20*d*.

When neutrons are to be generated in the target shown in FIGS. 3 and 4, the cooling water W is continuously supplied from outside of the container body 16 to the inflow port 26, passes through the space 17 and is continuously discharged through the outflow port 27 to outside of the container body 16.

The mercury M is continuously supplied from outside of the container body 16 to the inflow port 23, passes through the incoming and return passages 21 and 22 and is continuously discharged through the outflow port 24 to outside of the container body 16.

Under such conditions, proton beam P is irradiated so that protons pass through the outer shell 18 and container body 16 and collide against the mercury M which is flowing through the incoming and return passages 21 and 22. As a result, neutrons are generated.

In the target for the neutron scattering installation as described above, the flow of the mercury M through the incoming passage 21 toward the inner forward end of the container body 16 is rectified by a plurality of incoming-passage guide vanes 19*a*–19*d* and the flow of the mercury M through the return passage 22 toward the outflow port 24 is rectified by a plurality of return-passage guide vanes 20*a*–20*d*. As a result, occurrence of stagnation and/or re-circulation flows of the mercury M at the inner forward end of the container body 16 is suppressed. Consequently, a stead and highly uniform stream of the mercury M is formed throughout in the container body 16.

Therefore, increase in temperature due to stagnation of the mercury M is avoided and erosion due to re-circulation, too fast flow or the like does not occur on the inner surface of the container body 16.

Flow rate of the mercury M may be adjusted by varying the distance ratio between the guide vanes 19*a*–19*d* and/or 20*a*–20*d*.

Figure 1:
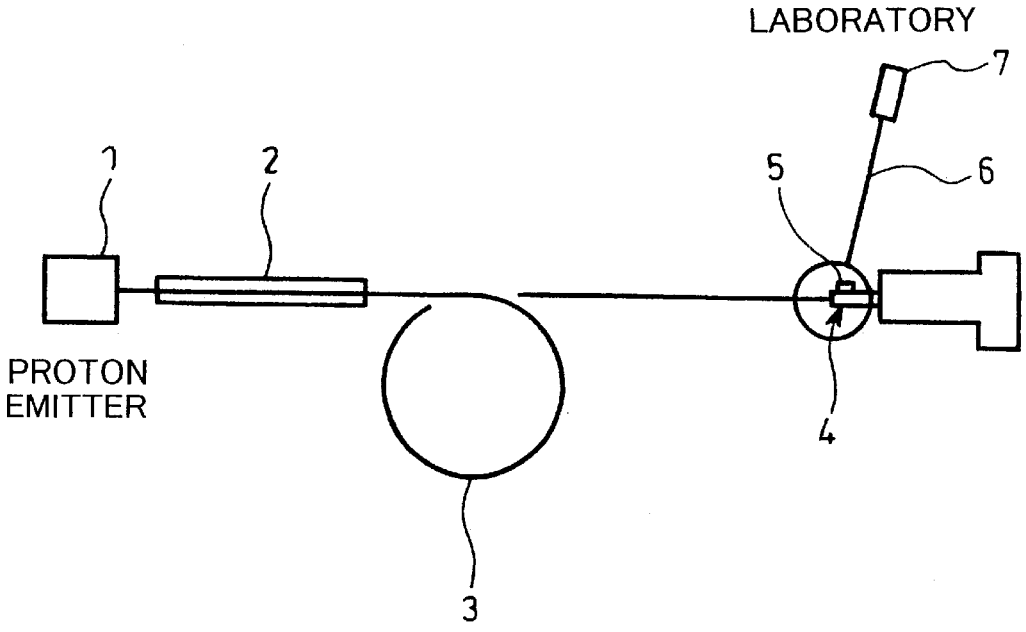
FIG. 1 PRIOR ART
FIG. 1 schematically shows an example of a neutron scattering installation.
Figure 2:
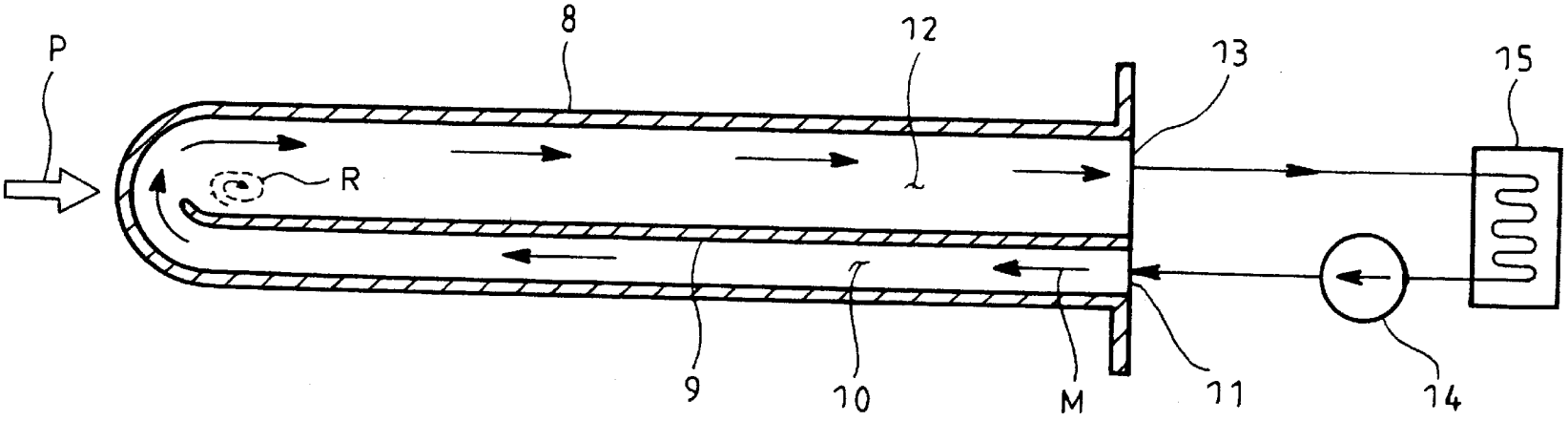
FIG. 2 PRIOR ART
FIG. 2 schematically shows a conventional target for a neutron scattering installation.

Further, heat generated by nuclear spallation reaction can be removed by mercury and the cooling water W passing through the space 17, which will relieve thermal load on the container body 16, outer shell 18 and mercury M and alleviate the burden on cooling means of, for example, a pump 14 for circulating the mercury M and a heat exchanger 15 (FIG. 2). Thus, nuclear spallation reaction having higher heat generated can be coped with.

Furthermore, since the thermal load is relieved as described above and the guide vanes 19*a*–19*d* and 20*a*–20*d* are used as reinforcement members for the container body 16, the container body 16 and outer shell 18 can be designed with thin wall, which will contribute to improvement of the efficiency to generate neutrons.

In addition, the container body 16 in which the mercury M flows is covered with the outer shell 18, which will prevent any leakage of the mercury M to outside as may occur when the container body 16 is damaged.

Figure 5:
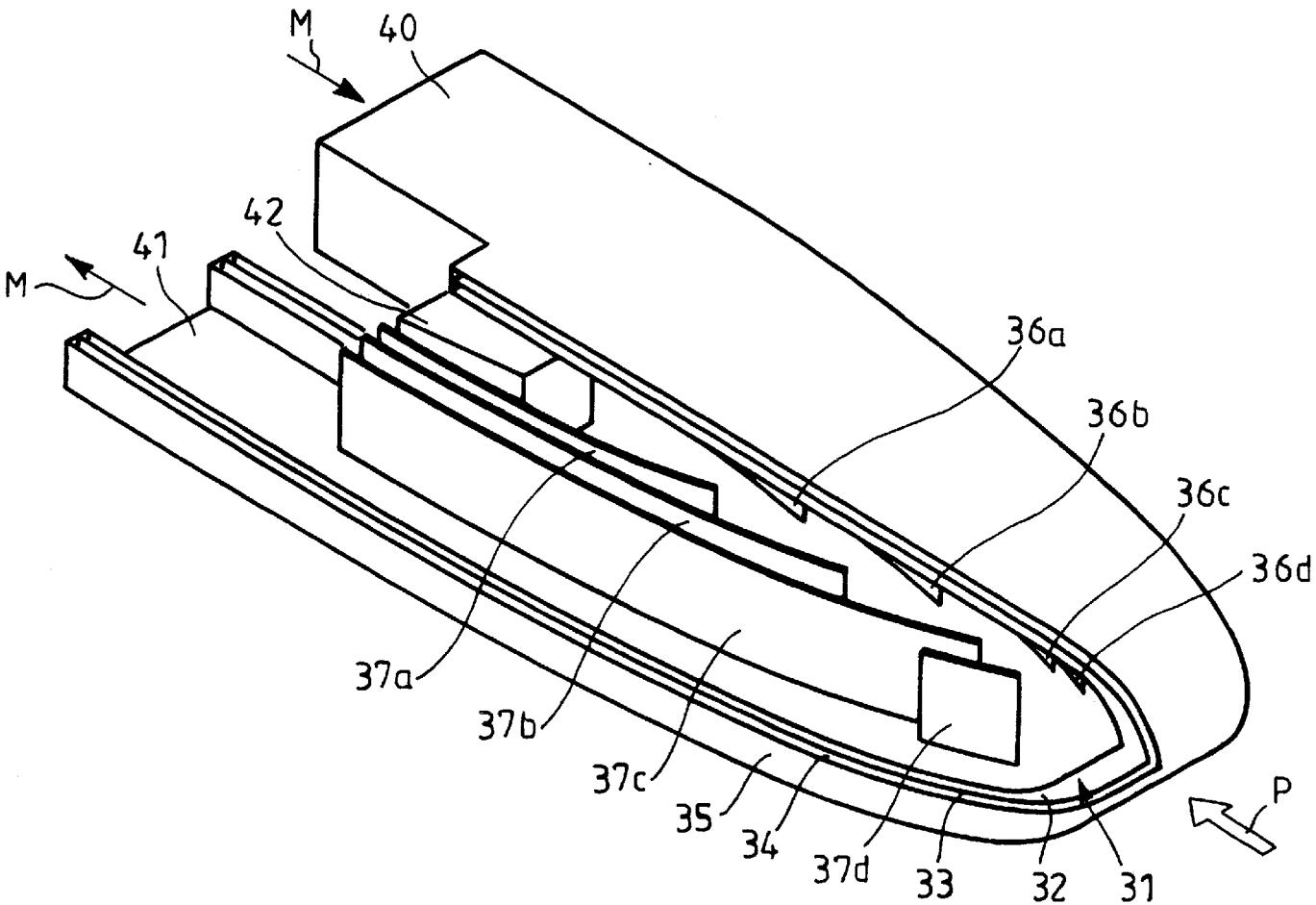
FIG. 5 is a perspective view partly in section of a second embodiment of the invention.
Figure 6:
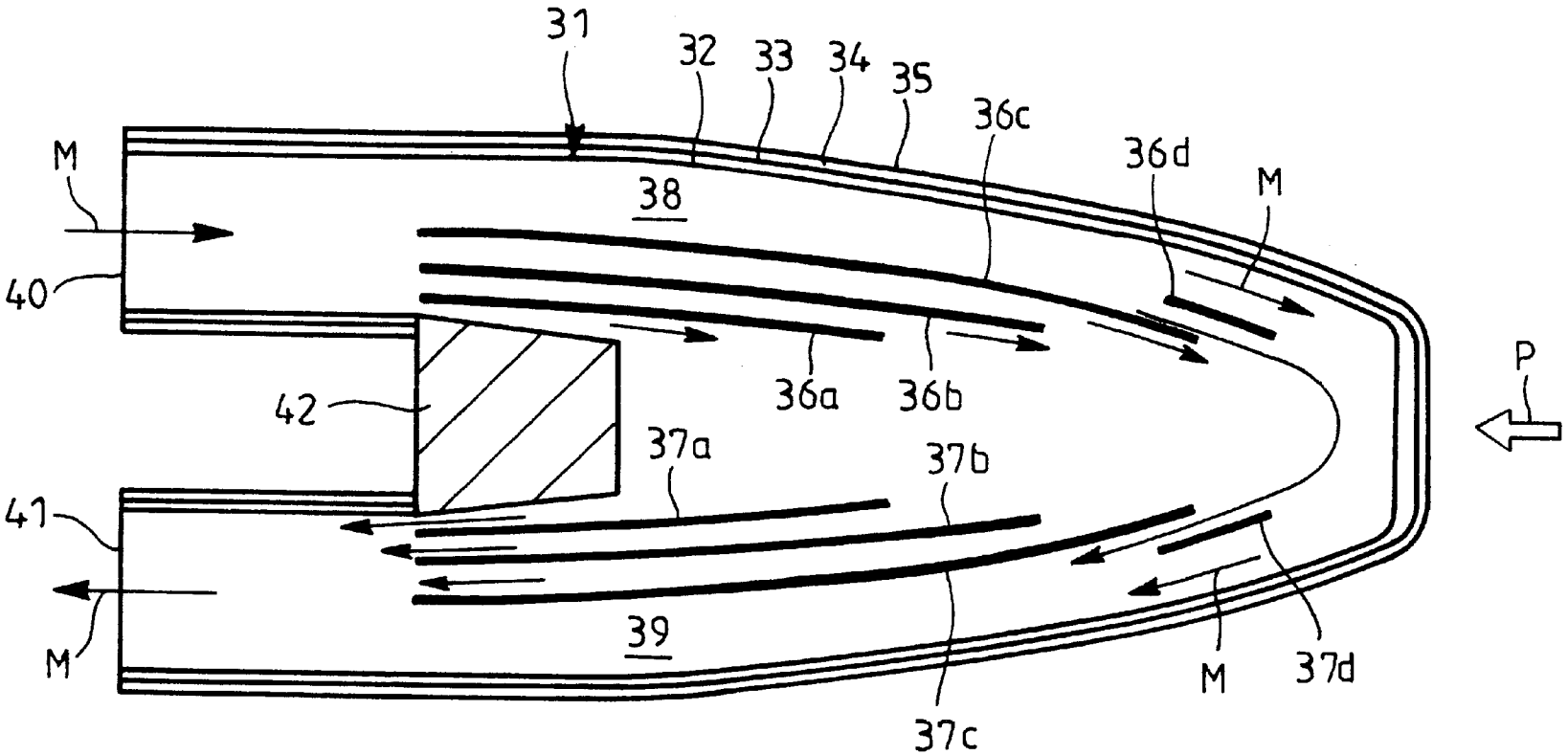
FIG. 6 is a horizontal sectional view of the second embodiment.

FIGS. 5 and 6 represent a second embodiment of a target for a neutron scattering installation of the present invention which comprises a thin-wall container body 31 arranged such that a proton beam P advancing approximately horizontally can enter a forward end of the body 31, a thin-wall container intermediate shell 33 for covering the container body 31 such that a space 32 is defined between the intermediate shell and an outer surface of the container body 31, a thin-wall container outer shell 35 for covering the intermediate shell 33 such that a space 34 is defined between the outer shell 35 and an outer surface of the intermediate shell 33 and incoming- and return-passage guide vanes 36*a*–36*d* and 37*a*–37*d* installed in the container body 31. A space in the container body 31 closer to one side of the body 31 provides a liquid-heavy-metal incoming passage 38 and a space in the container body 31 closer to the other side of the body 31 provides a liquid-heavy-metal return passage 39.

The container body 31 has, at its base ends, a liquid-heavy-metal inflow port 40 for inflow of the mercury M from, outside to the incoming passage 38 and a liquid-heavy-metal outflow port 41 for outflow of the mercury M from the return passage 39 to outside, independently from each other.

The container body 31 and intermediate shell 33 are closely fitted at,their base ends to each other to close a base end portion of the space 32 which is filled with helium (He) gas.

The intermediate and outer shells 33 and 35 are closely fitted at their base ends to each other to close a base end portion of the space 34. Through a cooling-medium feed passage (not shown), heavy water is supplied from outside of the container body 31 to the space 34 and is discharged to outside of the container body 31 via a cooling-medium discharge passage (not shown).

In the space 34, a guide member (not shown) contiguous with the inner surface of the outer shell 35 and outer surface of the intermediate shell 33 is installed at appropriate position, which will contribute to prevention of short-circuit flow of the heavy water from the cooling-medium feed passage to the cooling-medium discharge passage.

The incoming-passage guide vanes 36*a*–36*d* are arranged in the incoming passage 38 and have upper and lower edges contiguous with the inner surface of the container body 31. The guide vanes 36*a*–36*d* are laterally spaced apart from each other and are gradually curved toward the center of the container body 31 in a direction from the base end toward the forward end of the container body 31.

The return-passage guide vanes 37*a*–37*d* are arranged in the return passage 39 and have upper and lower edges contiguous with the inner surface of the container body 31. The guide vanes 37*a*–37*d* are laterally spaced apart from each other and are gradually curved toward the center of the container body 31 in a direction from the base end to the forward end of the container body 31.

These guide vanes 36*a*–36*d* and 37*a*–37*d* also serve as reinforcement members for the container body 31.

The container body 31 is provided, at a center of its base end, with a beam stopper 42 for blocking protons, which pass through the outer shell 35, intermediate shell 33, and container body 31 and advance between the guide vanes 36*a*–36*d* and 37*a*–37*d*.

When neutrons are to be generated in the target shown in FIGS. 5 and 6, the heavy water is continuously supplied from outside of the container body 31 to the feed passage, passes through the space 34 and is continuously discharged through the discharge passage to outside of the container body 31.

The mercury M is continuously supplied from outside of the container body 31 to the inflow port 40, passes through the incoming and return passages and 38 39 and is continuously discharged through the outflow port 41 to outside of the container body 31.

Under such conditions, proton beam P is irradiated so that protons pass through the outer shell 35, intermediate shell 33 and container body 31 and collide against the mercury M which is flowing through the incoming and return passage 38 and 39. As a result, neutrons are generated.

In the target for neutron scattering installation as described above, the flow of the mercury M through the incoming passage 38 toward the inner forward end of the container body 31 is rectified by a plurality of the incoming-passage guide vanes 36*a*–36*d* and the flow on the mercury M through the return passage 39 toward the outflow port 41 is rectified by a plurality of return-passage guide vanes 37*a*–37*d*. As a result, occurrence of stagnation and/or re-circulation flows of the mercury M at the inner forward end of the container body 31 is suppressed. Consequently, highly uniform and steadily flowing stream of the mercury M is formed throughout in the container body 31.

Therefore, increase in temperature due to stagnation of the mercury M is avoided and erosion due to recirculation, too fast flow or the like does not occur on the inner surface of the container body 31.

Flow rate of the mercury M may be adjusted by varying the distance ratio between the guide vanes 36*a*–36*d* and/or 37*a*–37*d*.

Further, heat generated by nuclear spallation reaction can be removed by mercury and the heavy water passing through the space 34, which will relieve thermal load on the container body 31, intermediate shell 33, outer shell 35 and mercury M and alleviate the burden on cooling means of, for example, a pump 14 for circulating the mercury M and a heat exchanger 15 (FIG. 4). Thus, nuclear spallation reaction having high heat generated can be coped with.

Furthermore, since the thermal load is relieved as described above and the guide vanes 36*a*–36*d* and 37*a*–37*d* are used as reinforcement members for the container body 31, the container body 31 and intermediate shell 33 can be designed with thin wall, which will contribute to improvement of the efficiency to generate neutrons.

In addition, the container body 31 in which the mercury M flows is dually covered by the intermediate and outer shells 33 and 35, which will prevent any leakage of the mercury M to outside as may occur when the container body 31 is damaged.

The space 32 may be filled with fluid other than helium. Fluid other than heavy water may be passed through the space 34.

What is claimed is:

1. A target for a neutron scattering installation comprising:

a container body configured such that a proton beam advancing approximately horizontally to a base of the container body enters a forward end of the container body and the proton beam divides the container body in two halves;

a plurality of incoming-passage guide vanes with upper and lower edges contiguous with an inner surface portion of the container body, said plurality of incoming-passage guide vanes being disposed in a first half of the container body, laterally spaced apart from each other with a gradual enlargement of a radius of each incoming-passage guide vane, and curved toward a center of the container body in a direction from an end of the base toward the forward end of the container body;

a plurality of return-passage guide vanes with upper and lower edges contiguous with the inner surface portion of the container body, said plurality of return-passage guide vanes being disposed in a second half of the container body, laterally spaced apart from each other with a gradual enlargement of a radius of each return-passage guide vane, and curved toward the center of the container body in the direction from the base end to the forward end of the container body;

a liquid-heavy-metal inflow port configured to allow an inflow of liquid heavy metal from outside of the container body to the incoming-passage guide vanes in the container body; and a liquid-heavy-metal outflow port configured to allow an outflow of the liquid heavy metal from the return-passage guide vanes outside the container body.

2. A target according to claim 1, further comprising a container outer shell configured to cover the container body.

3. A target according to claim 1, further comprising:

a container intermediate shell configured to cover the container body; and a container outer shell configured to cover the intermediate shell.

* * * * *

UNITED STATES PATENT AND TRADEMARK OFFICE

CERTIFICATE OF CORRECTION

PATENT NO. : 6,477,217 B1
DATED : November 5, 2002
INVENTOR(S) : Hino et al.

It is certified that error appears in the above-identified patent and that said Letters Patent is hereby corrected as shown below:

Title page,
Item [73], Assignee, should read:

-- [73] Assignees: Japan Atomic Energy Research Institute, Tokyo-to (JP); Ishikawajima-Harima Jukogyo Kabushiki Kaisha, Tokyo-to (JP) --

Signed and Sealed this

First Day of June, 2004

JON W. DUDAS
*Acting Director of the United States Patent and Trademark Office*